US006946782B1

(12) United States Patent
Beying et al.

(10) Patent No.: US 6,946,782 B1
(45) Date of Patent: Sep. 20, 2005

(54) CONNECTOR SYSTEM FOR A ROD-SHAPED TWO-ENDED DISCHARGE LAMP

(75) Inventors: Armin Beying, Stutensee (DE); Joachim Jung, Nürtingen (DE); Karlheinz Schworm, Frickenhausen (DE); Günter Fuchs, Oberboihingen (DE)

(73) Assignee: Isi Metz GmbH (DE)

( * ) Notice: Subject to any disclaimer, the term of this patent is extended or adjusted under 35 U.S.C. 154(b) by 0 days.

(21) Appl. No.: 10/130,514

(22) PCT Filed: Sep. 16, 2000

(86) PCT No.: PCT/EP00/09064

§ 371 (c)(1),
(2), (4) Date: May 20, 2002

(87) PCT Pub. No.: WO01/39237

PCT Pub. Date: May 31, 2001

(30) Foreign Application Priority Data

Nov. 20, 1999 (DE) ..... 199 55 979

(51) Int. Cl.[7] ..... H01K 7/00

(52) U.S. Cl. ..... 313/318.02; 313/318.01; 313/318.09; 439/239; 439/236

(58) Field of Search ..... 313/318.01, 318.02, 313/318.08, 318.09, 318.1, 318.11, 318.07, 492–493, 51, 318.12, 607; 439/239, 236, 612, 619, 607

(56) References Cited

U.S. PATENT DOCUMENTS 4,687,965 A * 8/1987 Sanders et al. ..... 313/318.05
4,751,422 A * 6/1988 Moianz et al. ..... 313/318.02
4,879,491 A * 11/1989 Hirozumi et al. ..... 313/318.1
4,906,891 A * 3/1990 Takagi et al. ..... 313/318.02
4,928,210 A * 5/1990 Hayakawa et al. ..... 362/217
4,949,007 A * 8/1990 Takagi et al. ..... 313/318.02
5,036,439 A * 7/1991 Hoffmann et al. ..... 362/459
5,221,874 A * 6/1993 Dayton ..... 313/318.01
5,266,866 A * 11/1993 Takagi et al. ..... 313/607
5,296,780 A * 3/1994 Haraden et al. ..... 313/318.09
5,479,066 A * 12/1995 Willems et al. ..... 313/318.05
5,696,424 A * 12/1997 Coushaine ..... 313/318.1
5,709,450 A * 1/1998 Francis et al. ..... 362/546
6,005,336 A * 12/1999 Helbig et al. ..... 313/318.01
6,270,235 B1 * 8/2001 Coushaine ..... 362/226

* cited by examiner

*Primary Examiner*—Joseph Williams
*Assistant Examiner*—Dalei Dong
(74) *Attorney, Agent, or Firm*—Pendorf & Cutliff

(57) ABSTRACT

A connector system for a rod-shaped two-ended gas discharge lamp (12) with bases (20) disposed on the connector ends (16) of the discharge lamp (12) and with insert sockets (22) for receiving the bases (20) in a lamp housing (14). Each base (20) is provided with a contact pin (26) linked with a lamp electrode (36) with an insulating cylinder (28) surrounding the contact pin (26) while leaving a lateral connector opening (46) free. Each insert socket (22) is provided with a contact element (58) that can be detachably engaged with the corresponding contact pin (26) through the connector opening (46) of the pertaining base (20) and can be impinged upon with a high voltage. The insert socket is further provided with an insulating body (60) that carries the contact element (58) and covers the connector opening (46) in the connected state.

21 Claims, 2 Drawing Sheets

CONNECTOR SYSTEM FOR A ROD-SHAPED TWO-ENDED DISCHARGE LAMP

CROSS REFERENCE TO RELATED APPLICATION

This application is a national stage of PCT/EP00/09064 filed Sep. 16, 2000 and based upon DE 199 55 979.1 filed Nov. 20, 1999 under the International Convention.

BACKGROUND OF THE INVENTION

1. Field of the Invention

The invention concerns a connector system for a rod-shaped two-ended discharge lamp, in particular a mercury high pressure lamp or a mercury medium pressure lamp, with two lamp bases provided at the connector ends of the discharge lamp and two insert sockets for receiving the lamp bases mounted spaced apart from each other in a lamp housing.

2. Description of the Related Art

Taking advantage of their emission in the UV-range, mercury high and medium pressure lamps are employed in radiation devices for many applications for influencing surfaces, in particular for environmentally safe hardening or curing of coatings, printing inks and paint. Depending upon soiling and wear, the lamp must be cleaned at intervals or, as the case may be, must be changed out. It is also necessary to remove the lamp for access to other component parts which must be serviced, such as reflectors. Thereby appropriate safety procedures must be met, since such UV-lamps are driven by high voltage and warm up to high temperatures during operation. With conventional connector systems for such lamps the voltage conducting connector cables to the lamp bases are materially joined with the electrode system. The removal of the lamp thus requires a work intensive disconnecting and freeing of the connector cables in the carrier housing under confined conditions. For this reason, it is often the case that essential cleaning operations or a necessary lamp change-out is postponed longer than necessary. In addition to this, there are safety problems due to metal parts which can be contacted, which can be subjected to voltage in the case of an accident during installation of the lamp. Further, it is frequently the case that such open conductor parts must be kept free relative to conductive housing parts by sufficient insulation areas, which leads to a reduced radiation zone for a given housing dimension.

SUMMARY OF THE INVENTION

Beginning therewith, it is the task of the present invention to provide a connector system which overcomes the above mentioned disadvantages and provides with a compact construction a simple assembly and high operational safety.

The invention is based upon the concept, of combining a simple mounting for the lamp with a reliable contact establishment. In accordance therewith it is proposed that the lamp bases which are respectively provided spaced apart at the connecting ends of the lamp longitudinal direction are provided with a contact pin connected electrically with a lamp electrode as well as an insulation housing surrounding the contact pin on all sides while however keeping open a side or lateral connector opening, and that the assembled unit includes respectively one contact element insertable through the connecting opening of the associated lamp base and releaseably contacting with the contact pin, and via connecting lines is energizable with high voltage, as well as an insulating body which carries the contact element and in the connected condition covers over the connection opening. Therewith, the possibility of a rapid replacement, with good all around insulation in the connected condition, is insured.

A particularly advantageous and reliable contact production is achieved thereby, that the contact pins are insertable and removable without tools from a slot extending radially perpendicular to the lamp longitudinal axis with production of a clamp connection with the contact elements.

In order to further simplify the insertion or plug-in mechanism, it is proposed that the contact elements are formed by a U-shaped spring contact, of which the spring shanks with their each other facing contact sides are spreadable under spring tension against the contact pin.

A further improvement of the contact production and contact effect can be achieved thereby, that the spring shanks of the spring contact exhibit an arch-shaped bent contact segment and an end segment bent or angled outwards, away from the contact side which lies flush against the contact pin over a partial circumference, wherein the gap-width of the insertion gap bordered by the end segments is smaller than the diameter of the contact pin.

It is also advantageous when the contact element can be anchored to the insulation body via a connection part which at the same time is connectable with the connection circuit. In order to insure a complete contact even in the case of deviations in form and position, it is advantageous when the contact element is mounted "floating" in the insulation body with free play. This can be accomplished for example by a spring disk formed by a spring element. Preferably, the connection part is formed by a core piece provided between the spring shanks of the spring contact and a threaded shaft formed on the core piece extending through the spring contact on its spring shank connecting base.

A particularly preferred shock protection and a secure covering-over of the conductive parts is advantageously achieved thereby, that the insulation body includes a U- or C-shaped support part, on the inner side of which the contact element is provided extending centrally. In a mechanically advantageous embodiment it is envisioned that the contact element is maintained fixed against rotation in a recess of the insulation body.

For simplification of assembly it is proposed that the insulation body exhibits a flange formed at the end side of the support part for securing to the lamp housing. Preferably the contact pin in the form of a hollow cylinder pin is internally contactable with a connection wire of the associated lamp electrode.

In order to facilitate the engagement of the contact element, it is proposed that a ring space is maintained free between the insulation housing and the therein concentrically provided contact pin.

For centering and supporting it is advantageous when the contact pin, on its end segment facing the discharge lamp, exhibits a radially projecting collar or flange lying against the inside of the insulation housing.

In order to ensure a sufficient mechanical rigidity or stability, it is advantageous when the insulation housing includes a support segment receiving the connecting end of the discharge lamp, preferably sealed with a ceramic cement, and a connection opening associated free end formed for mounting the contact pin. Therein it is advantageous when the end of the collar or flange of the contact pin borders the inner space of the support segment of the insulation housing.

Advantageously the contact pin is mounted or carried by its free end preferably formed by a narrowing centering connection projection supported in a central recess of an end wall forming the free end of the insulation housing. The insulating end wall makes it possible to dispense with further insulation segments in the lamp longitudinal direction, so that a compact apparatus design is made possible.

With respect to the mechanical stabilization a further improvement is achieved thereby, that the insulation housing includes a flattened wall part bordering on the connection opening, extending axially to a lamp end side, which in the connected condition comes into alignment with a facing plane surface of the insulation body.

In order to simplify the engagement of the contact element and to keep free a sufficient contact surface, it is advantageous when the connection opening viewed in the circumference direction of the insulation housing of the base exhibits an opening angle of at least 120° and in the axial direction of the insulation housing exhibits an opening breadth of at least 5 mm, preferably 10 mm.

Preferably, the insulation housing of the base and the insulation body respectively are comprised of a one-piece shaped part of an electric insulating, thermally conductive and heat resistant material, preferably a ceramic material.

In order to achieve a low transition or contact resistance and a high durability or longevity, it is of advantage, when the contact element and/or the contact pin are comprised of a stainless steel or copper or a copper-beryllium-alloy and in certain cases are coated or plated with an electrically highly conductive, non-oxidizing surface layer, preferably of gold or silver.

A further aspect of the invention concerns a discharge lamp, in particular a mercury discharge lamp or mercury medium discharge lamp for employment in an UV-radiating device, with sockets on two sides, a rod-shaped discharge lamp and an inventive connection device.

BRIEF DESCRIPTION OF THE DRAWINGS

In the following the invention will be described in greater detail on the basis of the illustrative embodiment represented in schematic manner in the figures. There is shown FIG. 1 a connection device for one connector end of a discharge lamp of which only one end is shown, in axial vertical section.

DETAILED DESCRIPTION OF THE INVENTION

Figure 1:
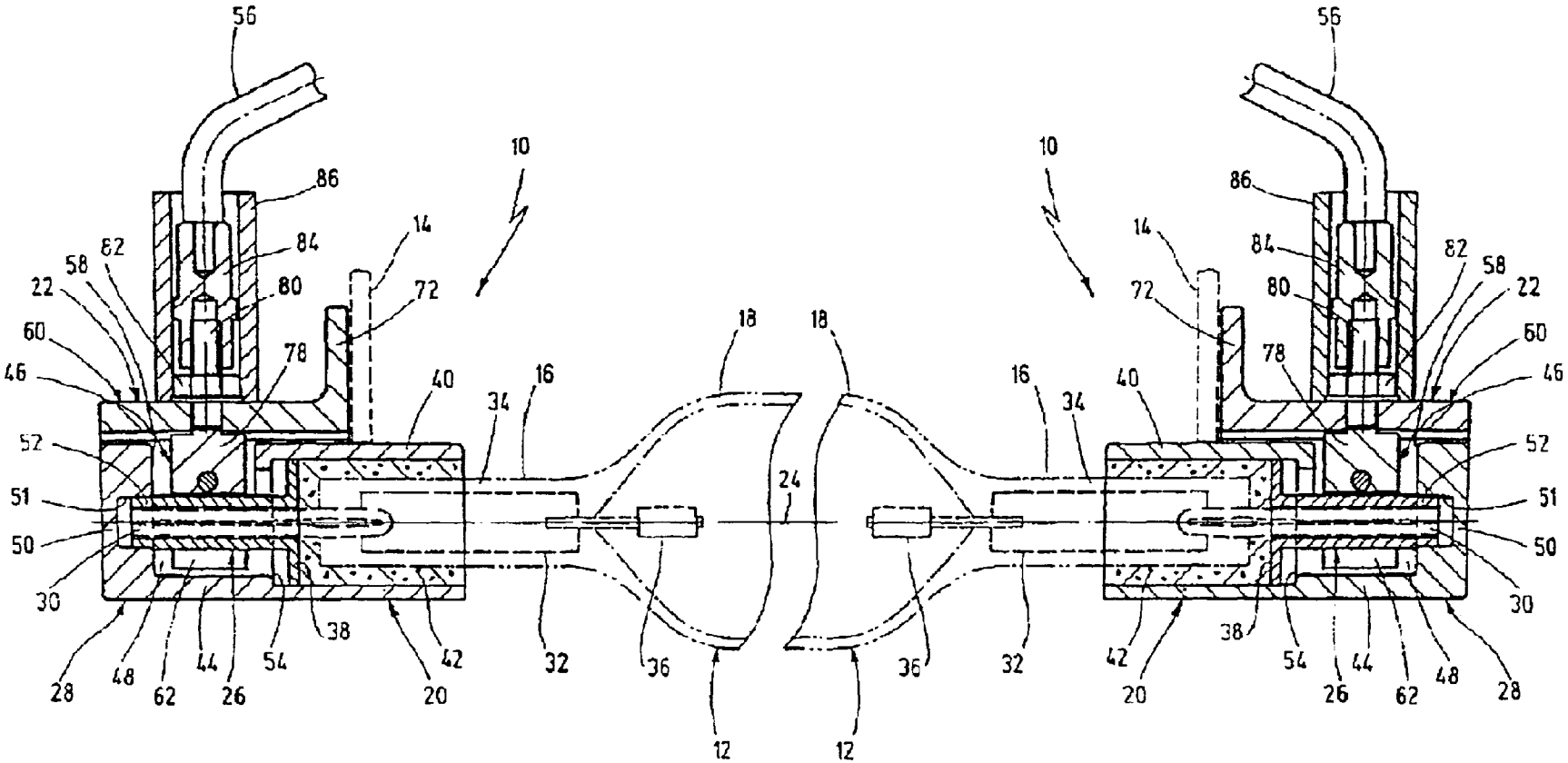
Figure 2:
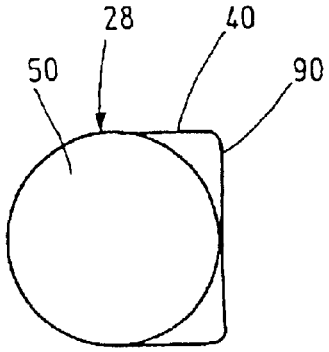
FIG. 2 and FIG. 3 a lamp base for the connection device in the end view and top view.

The connection device 10 shown in the figure or, as the case may be, connection fitting or mounting, serves for rapid replaceable mounting and for electrical connection of a rod shaped mercury vapor gas discharge lamp 12 in a housing 14 of a not shown UV-radiating device. It is comprised of essentially one lamp base 20 provided on the two connector ends 16 of the discharge tube 18 of the discharge lamp 12 as well as respectively one insert socket 22 for receiving the associated lamp bases or base 20.

The lamp bases 20 respectively exhibit one contact pin 26 projecting axially at the connector end 16, that is, in the direction of the lamp longitudinal axis 24, as well as a basically cylindrical ceramic insulating cylinder 28 provided co-axially to the contact pin 26. The contact pin 26 is designed as a hollow cylinder pin and is welded internally to a connection wire 30 extending out from the connector end, which is in electrical contact, via a metal band piece 32 extending through the glass melt 34, with a coiled pin electrode 36 projecting into the discharge tube 18. On its lamp end the contact pin 26 exhibits a radially projecting plate-shaped flange 38, which lies radially against the inner wall of the insulation housing 20.

The support segment 40, on the lamp-end of the insulation housing of the base 20, surrounds the connector end 16, and is form-fittingly connected therewith via a ceramic cement 42. On its end the connection area is separated by a flange 38 from a contact pin 26 receiving free end segment 44 of the insulation housing 20. The end segment 44 is provided with a lateral connector opening 46 formed by a radial interruption or through hole of the housing, which over the remainder however is closed off on all sides, keeping free a ring space 48 with respect to the contact pin 26. The connection opening 46 extends over an opening angle of approximately 160° in the circumference direction and has an axial opening breadth of approximately 10 mm. At its free end wall 50 the insulation housing of the base 20 exhibits a central, inwardly open blind borehole 51, in which the contact pin 26 is supported via a centering connector piece 52 which narrows toward the end. An inner shoulder 54 of the insulation housing 20 forms an abutment for the contact pin 26, wherein the collar or flange 38 thereof is provided for compensating differential thermal expansions in axial distance from the inner shoulder 54.

Figure 4:
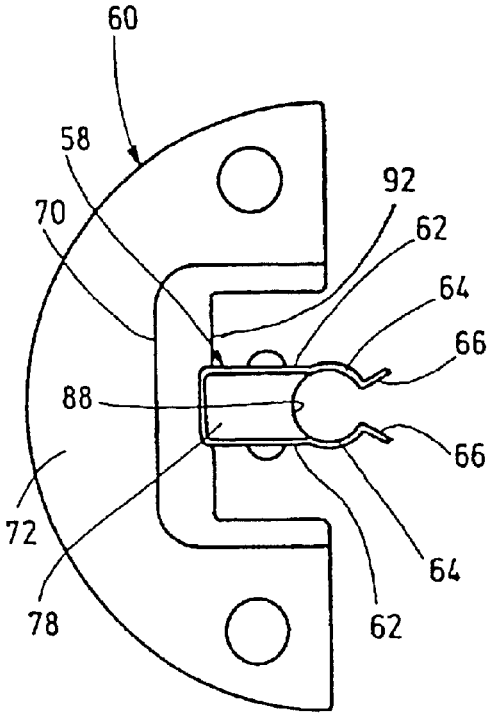
FIG. 4 and FIG. 5 an assembled representation of the connection device for receiving a lamp base in an end view and a top view.
Figure 5:
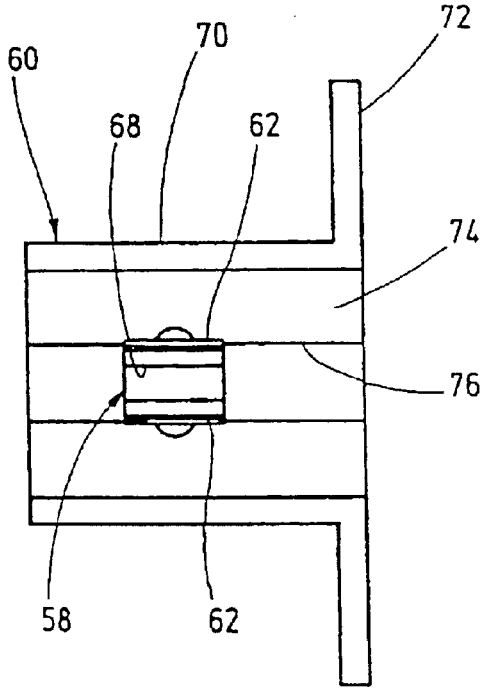

The insert socket 22 is comprised of a spring contact which can be brought into clamping contact with the contact pin 26 and via a connection cable 56 is chargeable with high voltage (greater than 1 kV) as well as a ceramic insulation body 60 carrying the spring contact 58. As can be best seen from FIG. 4, the U-shaped spring contact 58 exhibits two spring shanks 62, which with their each other facing contact sides are diametrically spreadable upon the contact pin 26. For this purpose the spring shanks 62 respectively exhibit a central segment 64 bent over their length conforming to the cross sectional contour of the contact pin, and an end segment 66 angled or bent towards the outside away from the contact side. Thereby the narrow width of the insertion gap 68 bounded by the end segment 66 is smaller than the diameter of the contact pin 26, so that the spring contact 58 is easily spreadable and in the connected condition is engageable with the contact pin 26.

Figure 3:
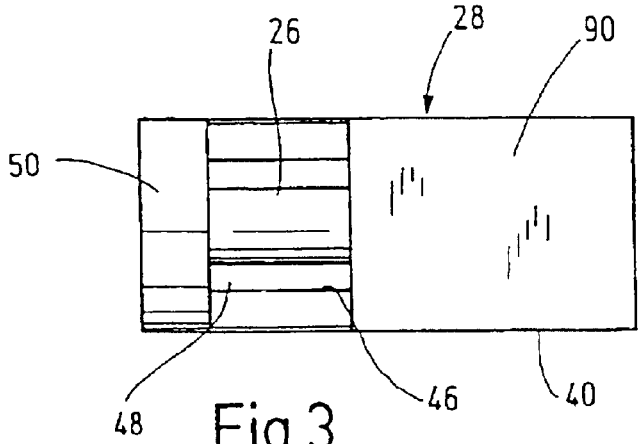

The insulation body 60 exhibits a receiving part 70 in the form of a U-shaped profile piece for receiving the lamp base 20 and a flange 72 formed on the end face of the receiving part 70 for a screw connection to the housing 14. The receiving part 70 is internally provided on its cross-piece 74 with a longitudinal groove 76, in which the spring contact 58 is maintained fixed against rotation on its base. For anchoring the spring contact 58 a core piece 78 is riveted between the spring shanks 62, which via a threaded shaft 80 extends through the cross piece 74 of the receiving part 70 and which on its back side is supported by means of a nut 82 (FIG. 1). On the projecting free end of the threaded shaft 80, a threaded socket 84 forming a connector socket for a connection cable 56 can be screwed on, which for its part in the assembled condition is insulated by a ceramic sleeve nut or cap or bushing 86. In order to further reduce the contact resistance, the core piece 78 on its contact side 88 lying against the contact pin 26 is formed concave complimentary to the outer contour thereof. For mechanical stabilization, the support segment 40 of the insulating cylinder 28 exhibits a flattened wall part 90 (FIG. 3) extending axially in the connection opening 46, which can be reliably engaged against tilting with the planar inner surface 92 of the cross piece 74 of the receiving part 70. A reliable position stabilization is achieved by the shanks of the receiving part 70 which, with their each other facing inner sides, center the sides of the support segment 40 of the insulating cylinder 28.

The discharge lamp 12 with its lamp base 20 can be assembled to and again removed in simple manner without tools from the insert sockets 22. Thereby the contact pins 26 are brought into engagement or, as the case may be, again released from engagement with the spring contacts 58 in a joining device running transverse to the lamp longitudinal axis 24. The free ring space 48 makes possible a corresponding spreading apart of the spring shanks 62. The receiving part 70 of the insulation body 60 covers over in the connected state the connection opening 46 of the insulating cylinder 28, so that an all side insulation in a safe protection from contact is achieved.

What is claimed is:

1. A connection device for a rod-shaped two-ended discharge lamp (12), in particular a mercury high pressure lamp or mercury medium pressure lamp, with two lamp bases (20) provided at the connector ends (16) of the discharge lamp (12) and two insert sockets (22) for receiving the lamp bases (20) mounted spaced apart from each other in a lamp housing (14), wherein the lamp bases (20) respectively exhibit one contact pin (26) extending in the longitudinal direction (24) from the connector end (16) of the lamp, electrically connected with a lamp electrode (36), as well as an insulating cylinder (28) completely surrounding the contact pin (26) on all sides with the exception of a lateral connection opening (46), and wherein the insert sockets (22) respectively exhibit a contact element (58) extending through the connection opening (46) of the associated lamp base (20) which is adapted to be brought into releasable engagement with its contact pin (26), which contact element (58) is energizable with high voltage via a connection line (56), as well as an insulation body (60) for carrying the contact element (58) and covering the connection opening (46) when in the connected condition.

2. The connection device according to claim 1, wherein the contact pins (26) can be engaged and disengaged without tools in a connecting device which extends perpendicularly to the lamp longitudinal axis (24), producing a clamp connection with the contact elements (58).

3. The connection device according to claim 1, wherein the contact elements (58) comprise a U-shaped spring contact, of which the spring shanks (62), with their each-other facing contact sides, are spreadable providing spring tension upon the contact pin (26).

4. The connection device according to claim 3, wherein the spring shanks (62) of the spring contact (58) exhibit a contact segment (64) bent into an arc lying flush over a partial circumference against the contact pin (26), as well as an end segment (66) bent outwardly away from the contact side, wherein the gap width of the insertion gap (68) bordered by the end segments (66) is smaller than the diameter of the contact pin (26).

5. The connection device according to claim 1, wherein the contact element (58) is anchored onto the insulation body (60) via a connection part (78, 80) which is connected at the same time with the connection line (56).

6. The connection device according to claim 1, wherein the contact element (58) is mounted at the insulation body (60) with tolerance or play via a spring element.

7. The connection device according to claim 5, wherein the connection part (78) is formed by a core piece provided between the spring shanks (62) of the spring contact (58) and a threaded shaft (80) formed on the core piece (78) and extending through the base connecting the spring shanks (62) of the spring contact (58).

8. The connection device according to claim 1, wherein the insulation body (60) exhibits a U- or C-shaped receiving part (70), on the inner side (92) of which the contact element (58) is provided, spaced apart, centrally.

9. The connection device according to claim 1, wherein the contact element (58) is maintained fixed against rotation in a recess (76) of the insulation body (60).

10. The connection device according to claim 1, wherein the insulation body (60) exhibits a flange (72) formed at the end face of the receiving part (70) for securing to the lamp housing (14).

11. The connection device according to claim 1, wherein the hollow cylinder pin-shaped contact pin (26) is adapted for forming an internal contact with the connection wire (30) of the associated lamp electrode (36).

12. The connection device according, to claim 1, whereby between the insulating cylinder (28) and the therein concentrically positioned contact pin (26) a ring space (48) is kept free for engagement of the contact element (58).

13. The connection device according to claim 1, wherein the contact pin (26) exhibits on its end segment facing the discharge lamp (12) a radially projecting flange (38) lying against the inward side of the insulating cylinder (28).

14. The connection device according to claim 1, wherein the insulating cylinder (28) includes a support segment (40) and a free end segment (44), the support segment (40) adapted for receiving the connector end (16) of the discharge lamp (12), preferably sealed by a ceramic cement (42), and the free end segment (44) provided with a lateral connection opening (46) and formed as a mounting for the contact pin (26).

15. The connection device according to claim 14, wherein the flange (38) of the contact pin (26) borders the end face of the inner space of the support segment (40) of the insulating cylinder (28).

16. The connection device according to claim 1, wherein the insulating cylinder (28) exhibits a flattened wall part (90) extending axially to its lamp-end side, bordering the connection opening (46), which in the connected condition comes into contact with an associated planar surface (92) of the insulation body (60).

17. The connection device according to claim 1, wherein the insulating cylinder (28) and the insulation body (60) are respectively comprised of a one piece shaped part of an electrically insulating, thermally conductive and heat resistant material, preferably a ceramic material.

18. The connection device according to claim 1, wherein the contact element (58) and/or the contact pin (26) are comprised of stainless steel or copper or a copper-beryllium-alloy, and optionally coated with an electrically highly conductive, non-oxidating surface layer, preferably gold or silver.

19. A connection device for a rod-shaped two-ended discharge lamp (12), in particular a mercury high pressure lamp or mercury medium pressure lamp, with two lamp bases (20) provided at the connector ends (16) of the discharge lamp (12) and two insert sockets (22) for receiving the lamp bases (20) mounted spaced apart: from each other in a lamp housing (14), wherein the lamp bases (20) respectively exhibit one contact pin (26) extending in the longitudinal direction (24) from the connector end (16) of the lamp, electrically connected with a lamp electrode (36), as well as an insulating cylinder (28) completely surrounding the contact pin (26) on all sides with the exception of a lateral connection opening (46), wherein the insert sockets (22) respectively exhibit a contact element (58) extending through the connection opening (46) of the associated lamp base (20) which is adapted to be brought into releasable engagement with its contact pin (26), which contact element (58) is energizable with high voltage via a connection line (56), as well as an insulation body (60) for carrying the contact element (58) and covering the connection opening (46) when in the connected condition, and wherein the contact pin (26) on its free end, preferably in the form of a narrowing centering extension (52), is mounted in a central recess (51) of an end wall (50) opposite to the pin forming the free end face of the insulating cylinder (28).

20. A connection device for a rod-shaped two-ended discharge lamp (12), in particular a mercury high pressure lamp or mercury medium pressure lamp, with two lamp bases (20) provided at the connector ends (16) of the discharge lamp (12) and two insert sockets (22) for receiving the lamp bases (20) mounted spaced apart from each other in a lamp housing (14), wherein the lamp bases (20) respectively exhibit one contact pin (26) extending in the longitudinal direction (24) from the connector end (16) of the lamp, electrically connected with a lamp electrode (36), as well as an insulating cylinder (28) completely surrounding the contact pin (26) on all sides with the exception of a lateral connection opening (46), wherein the insert sockets (22) respectively exhibit a contact element (58) extending through the connection opening (46) of the associated lamp base (20) which is adapted to be brought into releasable engagement with its contact pin (26), which contact element (58) is energizable with high voltage via a connection line (56), as well as an insulation body (60) for carrying the contact element (58) and covering the connection opening (46) when in the connected condition, and wherein the connection opening (46) exhibits an opening angle of at least 120° viewed in the circumference direction of the insulating cylinder (28) and in the axial direction of the insulating cylinder (28) exhibits an opening breadth of at least 5 mm.

21. A mercury-high-pressure lamp or mercury-medium-pressure lamp for employment in a UV-radiating device, with a rod-shaped discharge lamp (18) having connector ends on both sides, whereby a connection device (10) with two lamp bases (20) provided at the connector ends (16) of the discharge lamp (12) and two insert sockets (22) for receiving the lamp bases (20) mounted spaced apart from each other in a lamp housing (14), thereby characterized, that the lamp bases (20) respectively exhibit one contact pin (26) extending in the longitudinal direction (24) from the connector end (16) of the lamp, electrically connected with a lamp electrode (36), as well as an insulating cylinder (28) completely surrounding the contact pin (26) on all sides with the exception of a lateral connection opening (46), and that the insert sockets (22) respectively exhibit a contact element (58) extending through the connection opening (46) of the associated lamp base (20) which is adapted to be brought into releasable engagement with its contact pin (26), which contact element (58) is energizable with high voltage via a connection line (56), as well as an insulation body (60) for carrying the contact element (58) and covering the connection opening (46) when in the connected condition.

* * * * *